US009683199B2

(12) United States Patent
Truong et al.

(10) Patent No.: US 9,683,199 B2
(45) Date of Patent: Jun. 20, 2017

(54) FABRIC CONDITIONERS CONTAINING SOIL RELEASING POLYMER

(75) Inventors: Katie Truong, Piscataway, NJ (US); Charles John Schramm, Jr., Hillsborough, NJ (US)

(73) Assignee: Colgate-Palmolive Company, New York, NY (US)

( * ) Notice: Subject to any disclaimer, the term of this patent is extended or adjusted under 35 U.S.C. 154(b) by 494 days.

(21) Appl. No.: 13/883,640

(22) PCT Filed: Nov. 10, 2010

(86) PCT No.: PCT/US2010/056183

§ 371 (c)(1),
(2), (4) Date: May 6, 2013

(87) PCT Pub. No.: WO2012/064325

PCT Pub. Date: May 18, 2012

(65) Prior Publication Data

US 2013/0225475 A1 Aug. 29, 2013

(51) Int. Cl.

| | |
|---|---|
| ***C11D 3/37*** | (2006.01) |
| ***C11D 3/00*** | (2006.01) |
| ***C11D 1/62*** | (2006.01) |

(52) U.S. Cl.

CPC ..... *C11D 3/001* (2013.01); *C11D 1/62* (2013.01); *C11D 3/0015* (2013.01); *C11D 3/0036* (2013.01); *C11D 3/3707* (2013.01); *C11D 3/3788* (2013.01)

(58) Field of Classification Search

CPC ..... C11D 3/3707; C11D 3/3788

See application file for complete search history.

(56) References Cited

U.S. PATENT DOCUMENTS

| | | | | |
|---|---|---|---|---|
| 3,915,867 | A | 10/1975 | Kang et al. | |
| 4,746,456 | A | 5/1988 | Kud et al. | |
| 4,806,345 | A | 2/1989 | Bhattacharyya | |
| 4,925,577 | A | 5/1990 | Borcher, Sr. et al. | |
| 6,326,447 | B1 | 12/2001 | Fitzgerald | |
| 6,478,981 | B2 | 11/2002 | Fitzgerald | |
| 6,521,589 | B2 | 2/2003 | Demeyere et al. | |
| 6,864,223 | B2 | 3/2005 | Smith et al. | |
| 6,949,500 | B2 * | 9/2005 | Salesses et al. | 510/475 |
| 2002/0052457 | A1 | 5/2002 | Fitzgerald | |
| 2003/0119696 | A1 * | 6/2003 | Ingram et al. | 510/296 |
| 2004/0072709 | A1 * | 4/2004 | Wiedemann et al. | 510/296 |
| 2004/0171513 | A1 | 9/2004 | Blokzijl et al. | |
| 2007/0173433 | A1 | 7/2007 | Heibel et al. | |

FOREIGN PATENT DOCUMENTS

| | | | |
|---|---|---|---|
| CN | 1656203 | | 8/2005 |
| CN | 1942567 | | 4/2007 |
| CN | 101845754 | | 9/2010 |
| EP | 0936224 | | 8/1999 |
| EP | 1205538 | | 5/2002 |
| EP | 2196531 | * | 6/2010 |
| GB | 2304726 | * | 3/1997 |
| WO | WO 90/12862 | | 11/1990 |
| WO | WO 00/32732 | | 6/2000 |
| WO | WO2005103216 | | 11/2005 |

OTHER PUBLICATIONS

Ali et al., 2007, "Polyvinyl Alcohol Grafted Polyethylene Glycol Copolymer for Application in Floating Drug Delivery Systems," Controlled Release Society Meeting, Poster #411.

BASF, 2004, Kollicoat® Protect Technical Information, pp. 1-12.

International Search Report and Written Opinion in International Application No. PCT/US10/056183, mailed Feb. 1, 2011.

Written Opinion in International Application No. PCT/US10/056183, mailed Jan. 3, 2013.

* cited by examiner

*Primary Examiner* — John Hardee

(57) ABSTRACT

A fabric softening composition containing poly(vinyl alcohol)-poly(ethylene glycol) graft copolymers. The copolymer can be effectively deposited on the fabric from the fabric softening composition to provide protection from soil and enhanced soil removal on a broad range of fabric including nylon and cotton.

26 Claims, No Drawings

FABRIC CONDITIONERS CONTAINING SOIL RELEASING POLYMER

BACKGROUND

A variety of soil release compositions for fabric conditioning or fabric softener compositions have been introduced and are known in the art. The soil release compositions often contain polymers such as amphiphilic compounds based on a polyester backbone. These backbones can be copolymers of ethylene glycol and terephthalic acids or polyethylene terephthalate and polyethylene glycol polyester polyether. These polymers consist of hydrophilic and hydrophobic units and are analogous to synthetic fibers such as those found in polyester fabrics which contain terephthalate, ethyleneoxy or propyleneoxy polymeric units. The similarity in chemical structure of soil release polymers and polyester synthetic fabrics allow for binding or deposition of soil release polymers onto fibers and modify surface energy by imparting hydrophilic characteristics to fiber. This results in better cleaning by either retarding the attachment of oily soil to fibers and thus minimizes subsequent soiling or improving the wetting of fibers and susceptibility of a fabric to detergent during washing and thus, to facilitate soil removal. The benefits of these types of soil release polymers are limited to certain synthetic polyesters.

For different fabrics such as cotton or nylon, the difference in chemical composition and fabric properties requires different mechanisms for soil removal. Cotton is considered as a hydrophilic fabric. It contains hydroxyl end-groups which tend to fix stain and soil easier than polyester or other synthetic fabrics. Nylons are made of fiber of polyamides with terminal amino and carboxyl end groups.

There still is a need for compositions that can be incorporated during general washing or conditioning cycle and that protect fabrics from soil and enhance the removal of soil.

SUMMARY

In one embodiment, a fabric softening compositions containing (a) a fabric softener; and (b) a poly(vinyl alcohol)-poly(ethylene glycol) graft copolymer.

In other embodiments, the poly(vinyl alcohol)-poly(ethylene glycol) graft copolymer is supplied in a soil guarding composition that includes: (a) from 55 wt % to 65 wt % of poly(vinyl alcohol)-poly(ethylene glycol) graft copolymer; (b) from 35 wt % to 45 wt % of a poly(vinyl alcohol); and (c) from 0.1 wt % to 0.3 wt % of silicon dioxide.

In another embodiment, the fabric softening compositions include:

a) 0.01 wt % to 35 wt % of the softener, and the softener is an esterquat of formula:

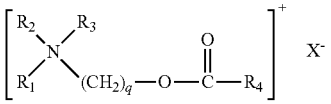

wherein $R_4$ is an aliphatic hydrocarbon group having from 8 to 22 carbon atoms;

$R_2$ and $R_3$, are, each independently, $(CH_2)_s$—$R_5$, wherein $R_5$ is an alkoxy carbonyl group containing from 8 to 22 carbon atoms, benzyl, phenyl, $C_1$-$C_4$ alkyl substituted phenyl, OH or H;

$R_1$ is $(CH_2)_t$—$R_6$, wherein $R_6$ is benzyl, phenyl, $C_1$-$C_4$ alkyl substituted phenyl, OH or H;

q, s, and t are, each independently, an integer from 1 to 3; and $X^-$ is a softener compatible anion;

b) 0.01 wt % to 6.5 wt % of a poly(vinyl alcohol)-poly (ethylene glycol) graft copolymer;

c) at least 0.001 wt % of a thickener, wherein the thickener is a water soluble cross-linked cationic polymer derived from the polymerization of 5 to 100 mole percent of a cationic vinyl addition monomer, 0 to 95 mole percent of acrylamide, and 70 to 300 ppm of a difunctional vinyl addition monomer cross-linking agent;

d) at least 0.001 wt % of lactic acid;

e) 0.001 wt % to 0.5 wt % of a chelating compound, wherein the chelating compound is amino trimethyl phosphonic acid;

f) 0.05 wt % to 0.5 wt % of a nonionic surfactant; wherein the nonionic surfactant is $C_{13-15}$ fatty alcohol EO 20:1; and g) 0.05 wt % to 0.8 wt % of a defoamer, wherein the defoamer is a silicone compound.

In another embodiment, methods for preventing soil deposit on a fabric or enhancing soil release from a fabric by applying a sufficient amount of the fabric softening compositions to a fabric.

DETAILED DESCRIPTION

As used throughout, ranges are used as a shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

In one aspect, provided are fabric softening compositions comprising:

a) a fabric softener; and b) a poly(vinyl alcohol)-poly(ethylene glycol) graft copolymer.

Some embodiments include poly(vinyl alcohol)-poly(ethylene glycol) graft copolymers of the formula:

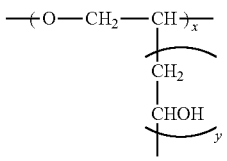

wherein, x and y are each degree of polymerization and independently a positive integer, and the ratio of x to y is from 1 to 2, from 1 to 3, or from 1 to 4.

In one embodiment, x and y in the poly(vinyl alcohol)-poly(ethylene glycol) graft copolymer are each independently a positive integer such as an integer from 500 to 1,400.

In another embodiment, the poly(vinyl alcohol)-poly(ethylene glycol) graft copolymer has average molecular weight of 30,000 daltons to 60,000 daltons, 40,000 daltons to 50,000 daltons, 20,000 daltons to 50,000 daltons, or 30,000 daltons to 40,000 daltons.

In one embodiment, the poly(vinyl alcohol)-poly(ethylene glycol) graft copolymer has average molecular weight of 30,000 daltons to 40,000 daltons, x and y are independently an integer from 900 to 1100. In another embodiment, the ratio of x to y is 1 to 3.

The poly(vinyl alcohol)-poly(ethylene glycol) graft copolymer can be purchased as Kollicoat® Protect polymer from BASF. Even though the poly(vinyl alcohol)-poly(ethylene glycol) graft copolymer is the active, the material as supplied from BASF includes the poly(vinyl alcohol)-poly (ethylene glycol) graft copolymer, poly(vinyl alcohol), and silicon dioxide. In certain embodiments, the Kollicoat® Protect from BASF, which is readily soluble in water, contains 55-65 wt % of the poly(vinyl alcohol)-poly(ethylene glycol) graft copolymer, 35-45 wt % of poly(vinyl alcohol), and 0.1-0.3 wt % of silicon dioxide. The amount of the Kollicoat® Protect from BASF included in the fabric softener compositions in certain embodiments is 0.01 wt % to 10 wt %, or 0.01 wt % to 5 wt %, and in certain embodiments about 1 wt. %. This converts to 0.01 wt. % to 6.5 wt %, 0.01 wt. % to 3.25 wt. %, or about 0.65 wt % of the poly(vinyl alcohol)-poly(ethylene glycol) graft copolymer by weight of the composition.

The fabric softening composition contains a fabric softener material. In certain embodiments, the softener is a cationic softener selected from among esterquats, imidazolinium quats, difatty diamide ammonium methyl sulfate, ditallow dimethyl ammonium chloride, and mixtures thereof.

In certain embodiments, the cationic fabric softener is an esterquat. The esterquats of the following formula:

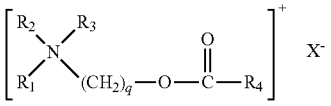

wherein $R_4$ is an aliphatic hydrocarbon group having from 8 to 22 carbon atoms, $R_2$ and $R_3$ represent $(CH_2)_s$—$R_5$, where $R_5$ is an alkoxy carbonyl group containing from 8 to 22 carbon atoms, benzyl, phenyl, $C_1$-$C_{-4}$ alkyl substituted phenyl, OH or H; $R_1$ is $(CH_2)_t$—$R_6$, where $R_6$ is benzyl, phenyl, $C_1$-$C_{-4}$ alkyl substituted phenyl, OH or H; q, s, and t, each independently, are an integer from 1 to 3; and $X^-$ is a softener compatible anion.

The esterquat is produced by reacting about 1.65 (1.5 to 1.75) moles of fatty acid methyl ester with one mole of alkanol amine followed by quaternization with dimethyl sulfate (further details on this preparation method are disclosed in U.S. Pat. No. 3,915,867). Using this ratio controls the amount of each of monoesterquat, diesterquat, and triesterquat in the composition. In certain embodiments, the alkanol amine comprises triethanolamine. In certain embodiments, it is desirable to increase the amount of diesterquat and minimize the amount of triesterquat to increase the softening capabilities of the composition. By selecting a ratio of about 1.65, the triesterquat can be minimized while increasing the monoesterquat.

Monoesterquat is more soluble in water than triesterquat. Depending on the AI, more or less monoesterquat is desired. At higher AI levels (usually at least 7%), more monoesterquat as compared to triesterquat is desired so that the esterquat is more soluble in the water so that the esterquat can be delivered to fabric during use. At lower AI levels (usually up to 3%), less monoesterquat is desired because during use, it is desired for the esterquat to leave solution and deposit on fabric to effect fabric softening. Depending on the AI, the amount of monoesterquat and triesterquat are adjusted to balance solubility and delivery of the esterquat.

In certain embodiments, the reaction products are 50-65 weight % diesterquat, 20-40 weight % monoester, and 25 weight % or less triester, which are shown below:

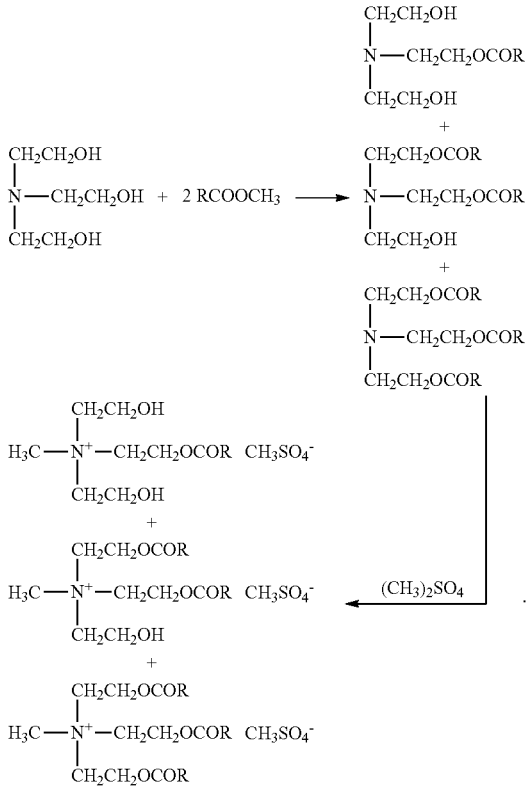

In other embodiments, the amount of diesterquat is 52-60, 53-58, or 53-55 weight %. In other embodiments, the amount of monoesterquat is 30-40 or 35-40 weight %. In other embodiments, the amount of triesterquat is 1-12 or 8-11 weight %.

The percentages, by weight, of mono, di, and tri esterquats, as described above are determined by the quantitative analytical method described in the publication "Characterisation of quaternized triethanolamine esters (esterquats) by HPLC, HRCGC and NMR" A. J. Wilkes, C. Jacobs, G. Walraven and J. M. Talbot—Colgate Palmolive R&D Inc.—4th world Surfactants Congress, Barcelone, 3-7 VI 1996, page 382. The percentages, by weight, of the mono, di and tri esterquats measured on dried samples are normalized on the basis of 100%. The normalization is required due to the presence of 10% to 15%, by weight, of non-quaternized species, such as ester amines and free fatty acids. Accordingly, the normalized weight percentages refer to the pure esterquat component of the raw material. In other words, for the weight % of each of monoesterquat, diesterquat, and triesterquat, the weight % is based on the total amount of monoesterquat, diesterquat, and triesterquat in the composition.

The fatty acids can be any fatty acid that is used for manufacturing esterquats for fabric softening. Examples of fatty acids include, but are not limited to, coconut oil, palm oil, tallow, rape oil, fish oil, or chemically synthesized fatty acids. In certain embodiments, the fatty acid is tallow.

While the esterquat can be provided in solid form, it is usually present in a solvent in liquid form. In solid form, the esterquat can be delivered from a dryer sheet in the laundry. In certain embodiments, the solvent comprises water.

The composition can be provided as a fragrance free composition, or it can contain a fragrance. The amount of fragrance can be any desired amount depending on the preference of the user. In certain embodiments, the amount of free fragrance oil is 0.3 to 1 weight % of the composition. Free fragrance capsule slurry mixtures could go up to 2 weight % of the composition. Typically, capsule loading is around 45 weight % fragrance oil.

Fragrance, or perfume, refers to odoriferous materials that are able to provide a desirable fragrance to fabrics, and encompasses conventional materials commonly used in detergent compositions to provide a pleasing fragrance and/or to counteract a malodor. The fragrances are generally in the liquid state at ambient temperature, although solid fragrances can also be used. Fragrance materials include, but are not limited to, such materials as aldehydes, ketones, esters and the like that are conventionally employed to impart a pleasing fragrance to laundry compositions. Naturally occurring plant and animal oils are also commonly used as components of fragrances.

The composition can contain any material that can be added to fabric softeners. Examples of materials include, but are not limited to, surfactants, thickening polymers, colorants, clays, buffers, silicones, fatty alcohols, and fatty esters.

The fabric conditioners may additionally contain a thickener. In one embodiment, the thickening polymer is the FLOSOFT™ DP200 polymer from SNF Floerger that is described in U.S. Pat. No. 6,864,223 to Smith et al., which is sold as FLOSOFT™ DP200, which as a water soluble cross-linked cationic polymer derived from the polymerization of from 5 to 100 mole percent of cationic vinyl addition monomer, from 0 to 95 mole percent of acrylamide, and from 70 to 300 ppm of a difunctional vinyl addition monomer cross-linking agent. A suitable thickener is a water-soluble cross-linked cationic vinyl polymer which is cross-linked using a cross-linking agent of a difunctional vinyl addition monomer at a level of from 70 to 300 ppm, preferably from 75 to 200 ppm, and most preferably of from 80 to 150 ppm. These polymers are further described in U.S. Pat. No. 4,806,345, and other polymers that may be utilized are disclosed in WO 90/12862. Generally, such polymers are prepared as water-in-oil emulsions, wherein the cross-linked polymers are dispersed in mineral oil, which may contain surfactants. During finished product making, in contact with the water phase, the emulsion inverts, allowing the water soluble polymer to swell. The most preferred thickener is a cross-linked copolymer of a quaternary ammonium acrylate or methacrylate in combination with an acrylamide comonomer. The thickener in accordance provides fabric softening compositions showing long term stability upon storage and allows the presence of relatively high levels of electrolytes without affecting the composition stability. Besides, the fabric softening compositions remain stable when shear is applied thereto. In certain embodiments, the amount of this thickening polymer is at least 0.001 weight %. In other embodiments, the amount is 0.001 to 0.35 weight %.

The fabric conditioner may further include a chelating compound. Suitable chelating compounds are capable of chelating metal ions and are present at a level of at least 0.001%, by weight, of the fabric softening composition, preferably from 0.001% to 0.5%, and more preferably 0.005% to 0.25%, by weight. The chelating compounds which are acidic in nature may be present either in the acidic form or as a complex/salt with a suitable counter cation such as an alkali or alkaline earth metal ion, ammonium or substituted ammonium ion or any mixtures thereof. The chelating compounds are selected from among amino carboxylic acid compounds and organo aminophosphonic acid compounds, and mixtures of same. Suitable amino carboxylic acid compounds include: ethylenediamine tetraacetic acid (EDTA); N-hydroxyethylenediamine triacetic acid; nitrilotriacetic acid (NTA); and diethylenetriamine pentaacetic acid (DEPTA). Suitable organo aminophosphonic acid compounds include: ethylenediamine tetrakis (methylenephosphonic acid); 1-hydroxyethane 1,1-diphosphonic acid (HEDP); and aminotri (methylenephosphonic acid). In certain embodiments, the composition can include amino tri methylene phosphonic acid, which is available as Dequest™ 2000 from Monsanto.

In certain embodiments, the composition can include a $C_{13}$-$C_{15}$ Fatty Alcohol EO 20:1, which is a nonionic surfactant with 20 an average of 20 ethoxylate groups. In certain embodiments, the amount is 0.05 to 0.5 weight %.

In certain embodiments, the composition can contain a silicone as a defoamer, such as Dow Corning™ 1430 defoamer. In certain embodiments, the amount is 0.05 to 0.8 weight %.

In the case of liquid fabric conditioner, a small amount of active can be effectively delivered and deposited through esterquat softener during the rinse cycle.

SPECIFIC EMBODIMENTS

The invention is further described in the following examples. The examples are merely illustrative and do not in any way limit the scope of the invention as described and claimed.

Example 1

General Material and Method

In general, ingredients were purchased and used as it is without further purification unless specified. Examples of suppliers for the ingredients include, Tetranyl™ L191 S 75% soft tallow/25% hard tallow from Kao, Inc.; amino trimethyl phosphonic acid: Dequest™ 2000 from MONSANTO; an 88% lactic acid solution from Sigma; $C_{13}$-$C_{15}$ fatty alcohol EO 20:1 non-ionic surfactant—A synthetic fatty alcohol with an ethoxylated chain containing 20 ethoxylates (Tensapol™ AO-20) from Polioles; polyacrylate thickening polymer emulsion in mineral oil, FLOSOFT™ DP200, (56% active) from SNF Floerger; and Dow Corning™ 1430 silicone from Dow Corning.

Example 2

Preparation of Fabric Conditioning Formulation

The fabric conditioner formulations were prepared by standard lab making procedure using an overhead stirrer at moderate mixing. Table 1 lists a liquid fabric conditioner formulation. Control sample with current esterquat active was prepared along with test product containing soil guarding composition ("invention") at 1% solid active concentration.

TABLE 1

Formulation

| Raw Materials | Wt % |
|---|---|
| Deionised Water | to 100%. |
| Lactic Acid | 0.06 |
| Dequest 2000 amino tri methylene phosphonic acid | 0.1 |
| L191S Esterquat | 7.4 |
| FLOSOFT ™ DP200 Polymer | 0.15 |
| Fragrance | 1 |
| Silicone 1430 | 0.5 |
| Soil guarding composition | 1 |

Example 3

Stain Removal Experiment

To measure the effectiveness of soil release by the fabric softening composition of the present invention, fabric swatches were washed and rinsed in full fabric load using the washing conditions specified below.

| | |
|---|---|
| Washer Type | Top loading |
| Wash Cycle | Normal |
| Wash Time | 10 minutes |
| Water Level | 60.6-68.1 liters (16-18 gal) |
| Wash Temperature | 25° C. (77° F.) |
| Rinse Temperature | Room temperature |
| Water Hardness | 150 ppm |
| Laundry Load Size | 3 kg |
| Drying | Line Drying |
| Condition/Setting | overnight ~23° C./ 40-50% R.H. |
| Detergent | Ariel Heavy Duty Detergent from Mexico |
| Dosage | 150 g |

During rinsing, either the fabric conditioner containing 1% soil guarding composition or a regular control product (without soil guarding composition) was used. The swatches were line dried in a constant temperature and humidity chamber. Swatches were subsequently soiled with a particular stain (e.g. motor oil, mustard) on a marked circle of two inches in diameter. Soiled swatches of the same stain were rewashed with a detergent without a rinse treatment.

The soil release benefit from soil guarding composition was measured as the change in colorimetric components: L, a, b after re-washing stained swatches which were previously treated with fabric conditioner containing soil guarding composition versus the control without soil guarding composition. Results are expressed as an average of three readings from triplicate samples of fabric types including cotton, 65/35 polyester/cotton blend, Dacron double knit polyester, and Banlon nylon.

The Hunter Reflectometer CIELAB with D65 illuminant, 10° observer is used to measure reflectance on the center of the circle where stain was placed. Three readings are taken for each swatch and an average value is calculated based on the three measurements.

The total color change denoted by DE is tabulated from three data points L, a, b of the control compared to treated swatches.

The total color difference (ΔE) is used to evaluate soil removal of treated swatch compared to a placebo control:

$$\Delta E=\sqrt{(\Delta a^{*2}+\Delta b^{*2}+\Delta L^{*2})}$$

TABLE 2

ΔE as stain removal benefits

| ΔE | Description |
|---|---|
| >2 | Visibly discernable stain fading |
| 4-10 | Moderate stain removal |
| 10-20 | Significant stain removal |
| >20 | Complete stain removal |

TABLE 3

Soil release potential of fabric conditioner of the present invention

| Fabric-Soil | L* (invention vs. control) | a* (invention vs. control) | b* (invention vs. control) | ΔE (invention vs. control) |
|---|---|---|---|---|
| Nylon-Motor Oil | 18.66 | −4.18 | −7.22 | 20.44 |
| Nylon-Mustard | 0.14 | −0.11 | −4.55 | 4.55 |
| Cotton-Mustard | 1.11 | −0.51 | −9.62 | 9.70 |

Table 3 lists the ΔE or total color changes of swatches that have been treated with a softener containing 1% soil guarding composition compared to control sample (without soil guarding composition). Results clearly demonstrate that soil guarding composition of the present invention provides benefit in soil release for oily soil.

Similar to motor oil, mustard is considered a hydrophobic soil. The greatest effect is observed for nylon fabric. Moderate effect is found for cotton and cotton blend fabric. As shown in Table 2, a ΔE of 2 is considered visually discernable stain fading. A ΔE of 10, generally means about 30% soil removal. ΔE of 20 or greater indicates almost to complete soil removal or 100% cleaning.

These swatches had been re-washed with a detergent after the soil was applied to the marked circle.

TABLE 4

Soil release potential of fabric conditioner of the present invention (No fabric conditioner rinse during re-washing of stained swatches)

| Fabric-Soil | L* (invention vs. control) | a* (invention vs. control) | b* (invention vs. control) | ΔE (invention vs. control) |
|---|---|---|---|---|
| DDK polyester - mustard | 1.22 | −0.24 | −7.45 | 8 |
| Nylon - mustard | 4.88 | −8.0 | −0.99 | 9 |

These swatches had been re-washed with a detergent and rinsed with fabric conditioner after the soil was applied to the marked circle.

TABLE 5

Soil release potential of fabric conditioner of the present invention (With fabric conditioner rinse during re-washing of stained swatches)

| Fabric-Soil | L* (invention vs. control) | a* (invention vs. control) | b* (invention vs. control) | ΔE (invention vs. control) |
|---|---|---|---|---|
| Cotton - mustard | 0.37 | −0.16 | −2.4 | 2 |
| Nylon - mustard | 0.03 | −0.5 | −3.92 | 4 |

TABLE 5-continued

| Soil release potential of fabric conditioner of the present invention (With fabric conditioner rinse during re-washing of stained swatches) | | | | |
|---|---|---|---|---|
| Fabric-Soil | L* (invention vs. control) | a* (invention vs. control) | b* (invention vs. control) | ΔE (invention vs. control) |
| 65/35 polyester cotton - chocolate | 5.55 | −1.92 | −4.43 | 7 |

These data clearly demonstrate the soil removal benefit of soil guarding composition of the present invention delivered by the fabric conditioner for stain such as motor oil and mustard. Effective soil release benefit is observed for fabric conditioner containing 1% soil guarding composition of the present invention on a broad range of fabric including blend cotton polyester to cotton. The most prominent effect is found for nylon.

What is claimed is:

1. A fabric softening composition, comprising a) a fabric softener, optionally a cationic fabric softener; and b) a poly(vinyl alcohol) and poly(ethylene glycol) graft copolymer;

wherein the poly(vinyl alcohol) and poly(ethylene glycol) graft copolymer has the formula:

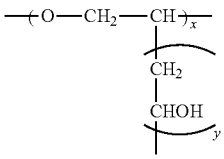

wherein, x and y are each independently a positive integer and the ratio of x to y is from 1 to 2, from 1 to 3, or from 1 to 4.

2. The composition of claim 1, wherein the composition further comprises poly(vinyl alcohol).

3. The composition of claim 1, wherein the composition further comprises silicon dioxide.

4. The composition of claim 1, wherein the composition comprises a soil guarding composition comprising:

a) 55 wt % to 65 wt % of the poly(vinyl alcohol) and poly(ethylene glycol) graft copolymer;

b) 35 wt % to 45 wt % of the poly(vinyl alcohol); and c) 0.1 wt % to 0.3 wt % of the silicon dioxide.

5. The composition of claim 4, wherein the amount of the soil guarding composition is from 0.01 wt % to 10 wt %.

6. The composition of claim 1, wherein the poly(vinyl alcohol) and poly(ethylene glycol) graft copolymer of has average molecular weight of 30,000 daltons to 60,000 daltons.

7. The composition of claim 1, wherein the fabric softener is a cationic softener selected from the group consisting of esterquats, imidazolinium quats, difatty diamide ammonium methyl sulfate, ditallow dimethyl ammonium chloride, and mixtures thereof.

8. The composition of claim 1, wherein the fabric softener is an esterquat.

9. The composition of claim 8, wherein the esterquat is a biodegradable fatty ester quaternary ammonium compound having the formula:

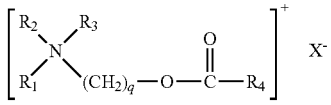

wherein $R_4$ is an aliphatic hydrocarbon group having from 8 to 22 carbon atoms;

$R_2$ and $R_3$, are, each independently, $(CH_2)_s$—$R_5$, wherein $R_5$ is an alkoxy carbonyl group containing from 8 to 22 carbon atoms, benzyl, phenyl, $C_1$-$C_4$ alkyl substituted phenyl, OH or H;

$R_1$ is $(CH_2)_t$—$R_6$, wherein $R_6$ is benzyl, phenyl, $C_1$-$C_4$ alkyl substituted phenyl, OH or H;

q, s, and t are, each independently, an integer from 1 to 3; and $X^-$ is a softener compatible anion.

10. The composition of claim 1, wherein the amount of the fabric softener is from 0.01 wt % to 35 wt %.

11. The composition of claim 1 further comprising a thickener.

12. The composition of claim 11, wherein the thickener is a water soluble cross-linked cationic polymer derived from the polymerization of 5 to 100 mole % of a cationic vinyl addition monomer, from 0 to 95 mole % of acrylamide, and 70 to 300 ppm of a difunctional vinyl addition monomer cross-linking agent.

13. The composition of claim 11, wherein the amount of the thickener is at least 0.001 wt %, or 0.001 wt % to 0.35 wt %.

14. The composition of claim 1 further comprising a chelating compound.

15. The composition of claim 14, wherein the chelating compound is selected from the group consisting of an amino carboxylic acid, an organo aminophosphonic acid, and mixtures thereof.

16. The composition of claim 15, wherein the amino carboxylic acid is selected from the group consisting of ethylenediamine tetraacetic acid (EDTA), N-hydroxyethylenediamine triacetic acid; nitrilotriacetic acid (NTA), diethylenetriamine pentaacetic acid (DEPTA), and mixtures thereof.

17. The composition of claim 15, wherein the organo aminophosphonic acid is selected from the group consisting of ethylenediamine tetrakis (methylenephosphonic acid), 1-hydroxyethane 1,1-diphosphonic acid (HEDP), aminotri (methylenephosphonic acid), and mixtures thereof.

18. The composition of claim 14, wherein the amount of the chelating compound is at least 0.001 wt %.

19. The composition of claim 1 further comprising a nonionic surfactant.

20. The composition of claim 19, wherein the amount of the nonionic surfactant is 0.05 wt % to 0.5 wt %.

21. The composition of claim 19, wherein the nonionic surfactant is $C_{13-15}$ fatty alcohol EO 20:1.

22. The composition of claim 1 further comprising a defoamer.

23. The composition of claim 22, wherein the defoamer is a silicon compound.

24. The composition of claim 22, wherein the amount of the defoamer is 0.05 wt % to 0.8 wt %.

25. The fabric softening composition of claim 1, which comprises:

a) 0.01 wt % to 35 wt % of the fabric softener, wherein the cationic softener is an esterquat of formula;

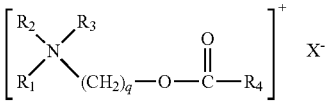

wherein $R_4$ is an aliphatic hydrocarbon group having from 8 to 22 carbon atoms;

$R_2$ and $R_3$, are, each independently, $(CH_2)_s$—$R_5$, wherein $R_5$ is an alkoxy carbonyl group containing from 8 to 22 carbon atoms, benzyl, phenyl, $C_1$-$C_4$ alkyl substituted phenyl, OH or H;

$R_1$ is $(CH_2)_t$—$R_6$, wherein $R_6$ is benzyl, phenyl, $C_1$-$C_4$ alkyl substituted phenyl, OH or H;

q, s, and t are, each independently, an integer from 1 to 3; and $X^-$ is a softener compatible anion;

b) 0.01 wt % to 6.5 wt % of the poly(vinyl alcohol) and poly(ethylene glycol) graft copolymer;

c) at least 0.001 wt % of a thickener, wherein the thickener is a water soluble cross-linked cationic polymer derived from the polymerization of 5 to 100 mole percent of a cationic vinyl addition monomer, 0 to 95 mole percent of acrylamide, and 70 to 300 ppm of a difunctional vinyl addition monomer cross-linking agent;

d) at least 0.001 wt % of lactic acid;

e) 0.001 wt % to 0.5 wt % of a chelating compound, wherein the chelating compound is amino trimethyl phosphonic acid;

f) 0.05 wt % to 0.5 wt % of a nonionic surfactant; wherein the nonionic surfactant is $C_{13-15}$ fatty alcohol EO 20:1; and g) 0.05 wt % to 0.8 wt % of a defoamer, wherein the defoamer is a silicone compound.

26. A method of preventing soil deposit or enhancing soil release from a fabric comprising depositing a sufficient amount of the composition of claim 1 on the fabric.

* * * * *